United States Patent [19]

Pignal et al.

[11] Patent Number: 4,756,169

[45] Date of Patent: Jul. 12, 1988

[54] DEVICE FOR LOADING AND UNLOADING ROTATING BASKETS FOR THE CENTRIFUGAL SPIN DRYING OF BOBBINS OF YARN

[75] Inventors: Maurice Pignal, Annonay; Bernard Chapuis, Lyons, both of France

[73] Assignee: Robatel SLPI, Genas, France

[21] Appl. No.: 54,312

[22] Filed: May 19, 1987

[30] Foreign Application Priority Data

May 30, 1986 [FR] France ..... 86 08077

[51] Int. Cl.[4] ..... F26B 11/08; F26B 5/08

[52] U.S. Cl. ..... 68/23 R; 34/8; 34/58; 57/76; 57/266; 57/312; 68/19.2; 210/360.1; 210/361; 210/380.1

[58] Field of Search ..... 57/76, 77, 312, 266, 57/267, 273; 68/19.2, 23 R, 23.1, 23.2, 23.3; 34/8, 58, 59; 210/360.1, 360.2, 361, 362, 380.1, 380.2; 494/42, 43, 48, 50, 52, 56, 60, 67, 76–78

[56] References Cited

U.S. PATENT DOCUMENTS

| | | | |
|---|---|---|---|
| 2,068,032 | 1/1937 | Bryant | 34/8 X |
| 2,094,579 | 10/1937 | Bradshaw et al. | 34/8 |
| 2,232,489 | 2/1941 | Prince-Smith | 57/77 |
| 2,232,490 | 2/1941 | Prince-Smith | 57/312 |
| 2,243,000 | 5/1941 | Brown | 34/8 X |
| 2,285,995 | 6/1942 | McDermott | 57/76 |
| 2,306,091 | 12/1942 | Thorneloe | 210/380.1 |
| 2,367,237 | 1/1945 | Pape | 57/76 X |
| 2,367,338 | 1/1945 | Crewdson | 57/76 X |
| 2,367,339 | 1/1945 | Pape | 57/76 X |
| 2,793,489 | 5/1957 | Svaty | 57/77 |
| 3,058,230 | 10/1962 | Grether | 34/58 |
| 3,340,685 | 9/1967 | Vignon | 57/77 X |
| 3,824,701 | 7/1974 | Norquist | 210/360.1 X |
| 3,827,985 | 8/1974 | DeHaan et al. | 210/380.1 X |
| 4,114,286 | 9/1978 | Bingham | 34/58 |
| 4,200,992 | 5/1980 | Zumpano | 68/19.2 X |
| 4,545,135 | 10/1985 | Barriquand et al. | 68/23 R X |

*Primary Examiner*—John Petrakes

*Attorney, Agent, or Firm*—Dowell & Dowell

[57] ABSTRACT

A device for loading and unloading a rotating basket in a centrifuge for spin drying bobbins of yarn wherein a hub is provided centrally of the basket and which guides an annular bearing plate which is vertically shiftable with respect to the basket so as to be selectively engageable with and supportive of a bobbin of yarn which is lowered into the basket, subjected to centrifugal action, and thereafter raised to a discharge position above the basket.

6 Claims, 3 Drawing Sheets

DEVICE FOR LOADING AND UNLOADING ROTATING BASKETS FOR THE CENTRIFUGAL SPIN DRYING OF BOBBINS OF YARN

BACKGROUND OF THE INVENTION

1. Field of the Invention

The present invention concerns the spinning of bobbins of yarn to remove moisture or liquids therefrom, particularly when they leave the autoclaves wherein the yarn is dyed or other heat treatment and prior to being introduced into the driers for finishing, and it relates more particularly to the positioning of these bobbins inside the rotatable baskets of centrifuges and to the removal thereof from these baskets at the end of the centrifugation operation.

SUMMARY OF THE INVENTION

The invention has for its object an improved device adapted to ensure the loading and unloading of bobbins of yarn into a centrifugal dryer are operations which are accomplished entirely automatically.

The device according to the invention comprises a hollow hub adapted to be axially fixed inside the basket of the centrifuge, which hub has at least one longitudinal slot cut out therein, in which slides a finger carried by a fork which is vertically reciprocal with the aid of an appropriate pusher element. This fork is secured with an annular plate which surrounds the hub and which is adapted to form support for each of the bobbins of yarn to be rotated within the centrifuge.

The reciprocating displacement of the pusher element is calculated so that the annular plate is disposed in high position at the level of a loading table which includes an opening adapted to permit the passage of the plate, and in low position is positioned against the bottom of the rotating basket of the centrifuge.

BRIEF DESCRIPTION OF THE DRAWING

The invention will be more readily understood on reading the following description with reference to the accompanying drawings, in which.

DESCRIPTION OF THE PREFERRED EMBODIMENT

Figure 1:
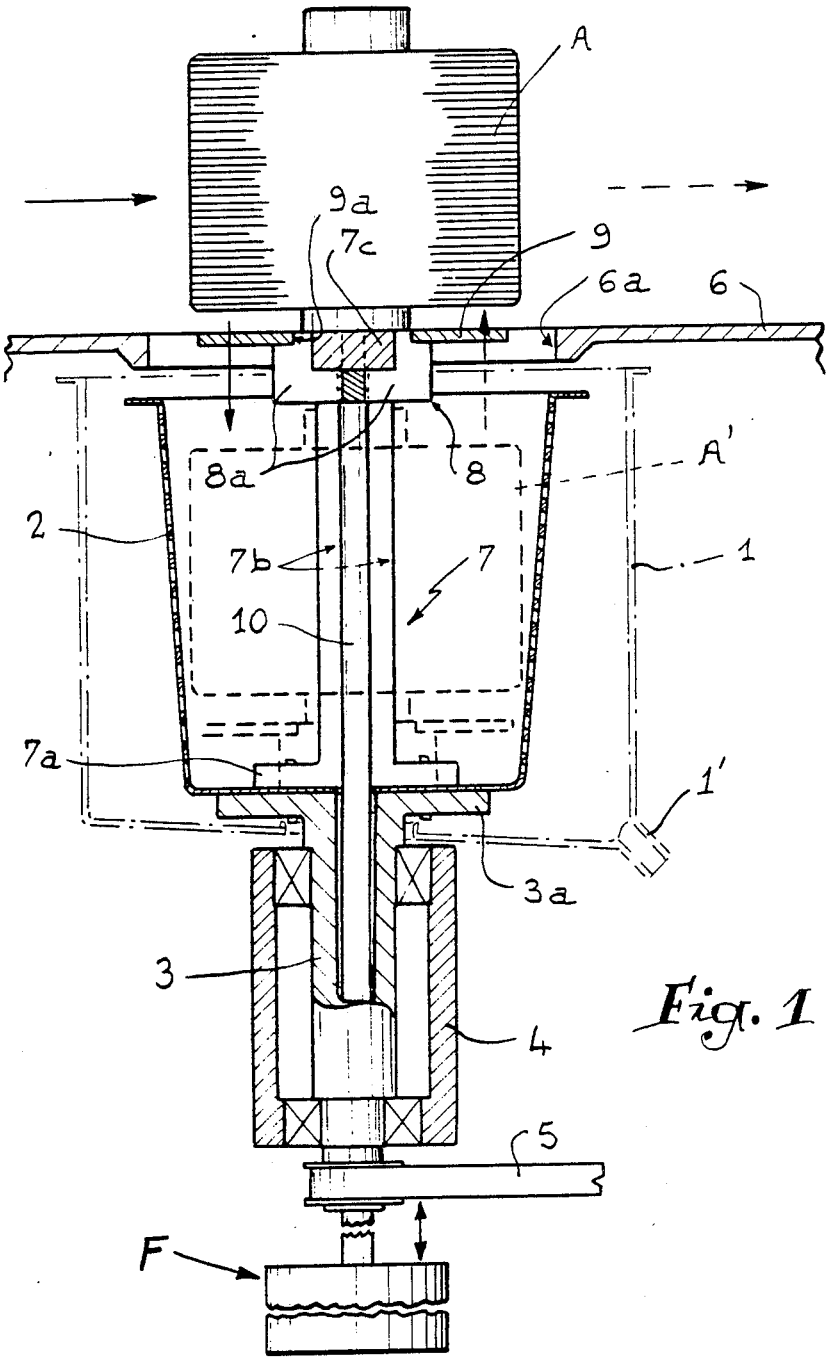
FIG. 1 is a partial axial section schematically showing the general arrangement of a centrifuge of which the basket is equipped with a loading and unloading device according to the invention.

Referring now to the drawings, FIG. 1 schematically shows at 1 the fixed vessel of a conventional centrifuge, provided with a vertical-axis basket 2 disposed inside the vessel 1 and a liquid drain shown at 1'. The bottom of the basket 2 is secured with the upper flange 3*a* of a hollow shaft 3 maintained inside a fixed part 4 of the general frame of the machine. This shaft 3 is driven in rotation in any appropriate manner, for example by a belt transmission 5. It will be observed that the open upper part of the basket 2 is surmounted by a table 6 in which is cut out an opening 6*a* allowing access to the basket.

Figure 2:
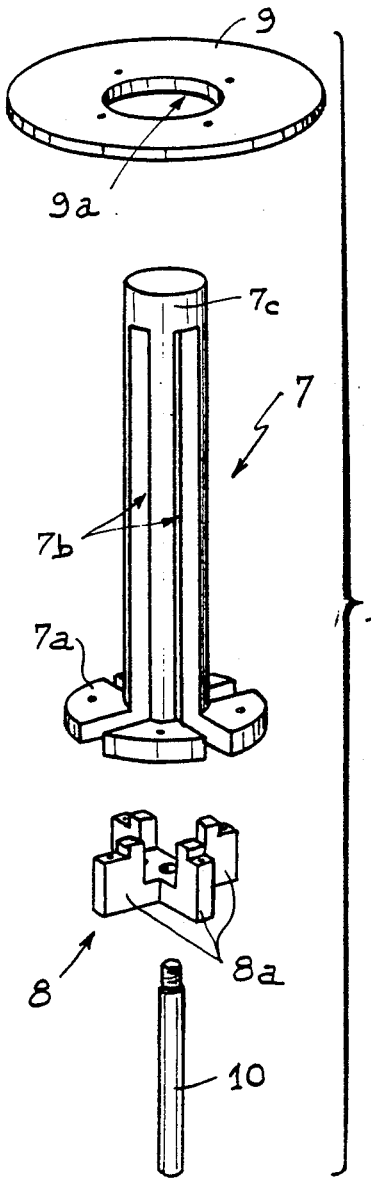
FIG. 2 is a view in perspective of the different elements constituting this device, shown prior to assembly thereof.
Figure 3:
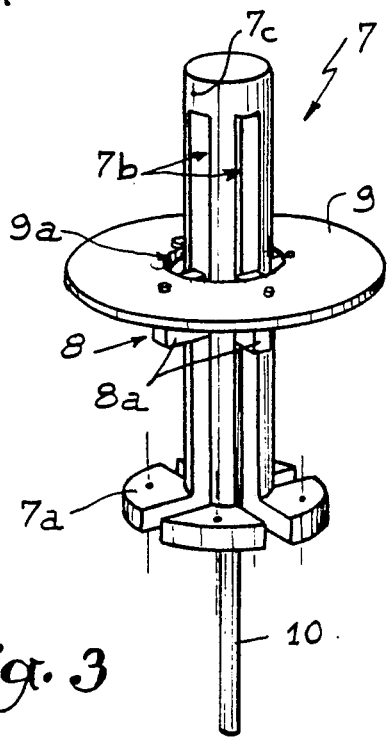
FIG. 3 reproduces FIG. 2 after assembly of the constituent elements.

A loading and unloading device according to the invention comprises a vertical hub 7 mounted axially inside the basket 2 with which it is secured to a lower flange 7*a* applied against the bottom of the basket. As shown in FIGS. 2 and 3, this hub 7 has longitudinal slots 7*b* cut out therein, four in number in the embodiment shown, which start from the lower flange 7*a* but which stop, on the contrary, at a certain height below the upper end of the hub in order to form a centering endpiece 7*c*.

Into the blind axial bore of the hub 7 there is slidably engaged a fork 8, provided with four fingers 8*a* in the same arrangement as the slots 7*b* so as to be able to be introduced thereinto. On these fingers 8*a* is fixed a plate 9 pierced with a central opening 9*a* for the passage of the hub 7. Opposite this plate 9, the fork 8 is secured, for example by screwing, with the end of a pusher element 10 which axially traverses the hollow shaft 3 to cooperate with an actuating member which, in FIG. 1, has been schematized in the form of a double arrow F and which is adapted to displace it along its axis, in vertically reciprocating motion. This member F may in particular be constituted by a pneumatic or hydraulic jack, of the double-effect type.

Operation of the device described above follows from the foregoing explanations and will be readily understood.

When the actuating member F is at the upper end of stroke for which the fingers 8*a* surround the endpiece 7*c* of the hub 7, the plate 9 is disposed at the height of table 6, so that it may receive, by a simple lateral thrust, a bobbin of yarn to be rotated within the centrifuge, such as the one indicated at A in FIG. 1. Once the bobbin A has been placed on the plate 9, the plate lowers by an effect on traction exerted by the pusher element 10, until the fork 8, whose downward slide is guided by the cooperation of the fingers 8*a* and slots 7*b*, abuts against the lower flange 7*a* of the hub. The bobbin is thus brought to position A', inside the basket 2 which may effect spinning or spin drying thereof as soon as it is driven in rotation at high speed by transmission 5.

At the end of spinning, the plate 9 may, of course, be returned to the high position by the pusher element 10 so that the bobbin can be evacuated laterally onto the table 6, and it will be understood that all the operations for loading and unloading the basket 2 are carried out entirely automatically, without any manual intervention.

It goes without saying that the number of fingers 8*a* of fork 8 and of the slots 7*b* of hub 7 may vary to a wide extent, in particular as a function of the diameter of the hub and of the weight of the bobbins to be treated.

It must, moreover, be understood that the foregoing description has been given only by way of example and that it in no way limits the domain of the invention which would not be exceeded by replacing the details of execution described by any other equivalents.

Figure 4:
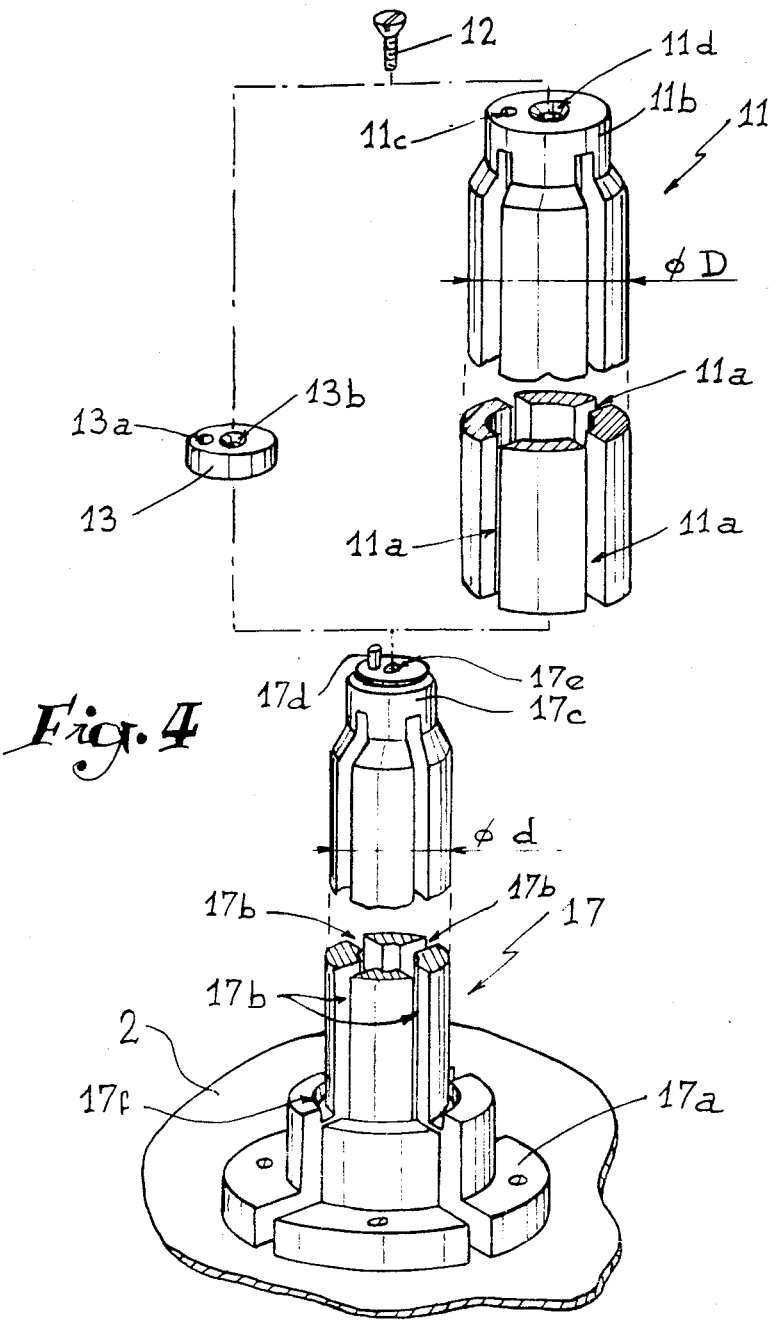
FIG. 4 illustrates in perspective a variant embodiment of the invention.

In particular, when the bobbins to be treated with the centrifuge present a spindle of which the internal diameter is largely greater than the outer diameter d of the hub of the basket, the hub may be provided with a dismountable sleeve of the type referenced 11 in FIG. 4. This sleeve 11, of external diameter D, is provided to be tubular so as to engage on the hub, here referenced 17, carried by the bottom of the basket 2, and it has longitudinal slots 11*a* cut out therein, identical in number and in disposition to the slots 17*b* of the hub, while its top is provided with a centering endpiece 11*b* which covers the endpiece 17*c* of the hub. It will be observed that this endpiece 17*c* is secured to an offset vertical pin 17*d* adapted to be introduced into a corresponding perforation 11*c* made in the endpiece 11*b* to effect positive drive of the sleeve 11 by the hub 17.

Axial fixation of the dismountable sleeve 11 is ensured with the aid of a screw 12 which passes through a hole 11*d* in the endpiece 11*b* to cooperate with an axial tapping 17*e* in hub 17; it will be noted that, when this latter is used without sleeve 11, its endpiece 17*c* receives a cap 13 pierced at 13*a* and at 13*b* to allow engagement of pin 17*d* and of screw 12 respectively, thus giving assembly 17–13 the same height as that presented by assembly 17–11. In addition, the base of sleeve 11 is maintained in an annular groove 17*f* made in the lower flange 17*a* of hub 17. It goes without saying that the opening 9*a* of plate 9 must present a diameter sufficient to allow passage of the sleeve 11.

What is claimed is:

1. An apparatus for loading and unloading bobbins of yarn into a centrifugal spin dryer having a rotatable basket in which the bobbins are selectively received and wherein the basket is positioned below an opening in a surface structure across which the bobbins of yarn are transported comprising, a vertically oriented hub means mounted within the basket and having upper and lower ends, at least one elongated guide means disposed along said hub means, a plate means mounted around said hub means and extending generally perpendicularly thereto, support means slideably movable relative to said elongated guide means of said hub means, said plate means being carried by said support means, and reciprocating means engaging said support means so as to raise said plate means into a first position in substantially horizontal alignment with the surface structure within the opening therein and to lower said plate means to a second position within the basket.

2. The apparatus of claim 1 in which said plate means includes a central opening therethrough, said central opening being of a first diameter, said hub means having a second diameter, said first diameter being greater than said second diameter whereby said plate means is radially spaced from said hub means.

3. The apparatus of claim 1 in which said guide means extends from adjacent said lower end of said hub means to a point spaced inwardly of said upper end of said guide means.

4. The apparatus of claim 3 in which said guide means includes at least one elongated slot formed within said hub means, said at least one elongated slot communicating with an axial bore extending substantially through and axially aligned with said hub means, said support means including a fork portion which is slideably engageable within said axial bore, a finger portion mounted to said fork portion and extending through said at least one elongated slot in said hub means, and said reciprocating means including an elongated pusher element connected to said fork portion of said support means so as to selectively urge said fork portion of said support means vertically within said axial bore in said hub means.

5. The apparatus of claim 4 including a plurality of slots extending through said hub means, each of said slots communicating with said axial bore within said hub means, a plurality of finger portions extending from said fork portion of said support means, each of said finger portions extending through one of said slots.

6. The apparatus of claim 5 including a disengageable secondary hub means, said secondary hub means having an axial bore extending substantially therethrough, a plurality of vertical slots formed in said secondary hub means, said secondary hub means being of a size to be cooperatively received in overlying engagement with said hub means with said vertical slots of said secondary hub means being vertically aligned with said slots in said hub means, and means for securing said secondary hub means in fixed relationship with said hub means.

* * * * *